United States Patent [19]

Saito

[11] Patent Number: 4,564,983

[45] Date of Patent: Jan. 21, 1986

[54] DEVICE FOR FASTENING A BELT OR THE LIKE

[75] Inventor: Koji Saito, Tokyo, Japan

[73] Assignee: Kohshoh Limited, Kyoto, Japan

[21] Appl. No.: 576,946

[22] Filed: Feb. 3, 1984

[30] Foreign Application Priority Data

Feb. 4, 1983 [JP] Japan ..... 58-15086[U]
Apr. 8, 1983 [JP] Japan ..... 58-61945

[51] Int. Cl.[4] ..... A44B 19/00
[52] U.S. Cl. ..... 24/170; 24/191
[58] Field of Search ..... 24/180, 181, 191, 178, 24/573, 170, 168, 163 R, 188, 498, 489, 618

[56] References Cited

U.S. PATENT DOCUMENTS

| | | | |
|---|---|---|---|
| 3,471 | 3/1844 | Verplank | 24/170 |
| 3,883 | 1/1845 | Frashure | 24/170 |
| 1,064,996 | 6/1913 | Rubin | 24/191 |
| 1,236,121 | 8/1917 | Stuart | 24/191 |
| 1,500,907 | 7/1924 | Tucker | 24/191 X |
| 4,369,553 | 1/1983 | Yuda | 24/618 |

FOREIGN PATENT DOCUMENTS

| | | | |
|---|---|---|---|
| 1333646 | 6/1963 | France | 24/191 |
| 132912 | 10/1919 | United Kingdom | 24/170 |
| 299248 | 10/1928 | United Kingdom | 24/178 R |

*Primary Examiner*—William E. Lyddane

*Assistant Examiner*—Laurie K. Cranmer

*Attorney, Agent, or Firm*—Fidelman, Wolffe & Waldron

[57] ABSTRACT

A device for fastening a belt or the like, which comprises a first and a second component member. The first component member comprises a base plate, a pair of upstanding side walls and a cross rod having its opposite ends connected to the top ends of the side walls so that the base plate, the side walls and the cross rod form a frame defining a passage through which the belt or the like is to be passed. A bearing recess is formed in the inner surface of each of the side walls. The second component member comprises a body portion and a fastening portion extending angularly from one end of the body portion. The body portion is provided at the one end with a pair of pintles axially aligned and laterally outwardly projecting in opposite directions from the opposite lateral sides of the body portion and in the upper surface thereof with a bearing groove extending adjacent the one end of the body portion and in parallel with the common axis of the aligned pintles. The body portion is further provided at the opposite end with a slot for the belt to be attached to the second component member. The first and second component members are assembled with each of the pintles being engaged in one of the bearing recesses and the cross rod being engaged in the bearing groove so that the second component member is pivotable about the cross rod of the first component member.

6 Claims, 9 Drawing Figures

DEVICE FOR FASTENING A BELT OR THE LIKE

BACKGROUND OF THE INVENTION

This invention relates to a novel and improved fastening device or buckle for use with a belt, a band or the like.

Most of such conventional fastening devices are made of metal and have a sufficient structural strength. In recent years, however, the tendency is that they are made of plastic material, which renders them structurally weaker than if they are made of metal so that they are likely to be damaged or broken.

A conventional buckle is shown in FIG. 9 comprising a first component member 30 and a second compounent member 34 pivotally connected to the first component member. The first component member 30 comprises a base plate 31 having its opposite lateral portions bent perpendicularly thereto to form a pair of upstanding side walls 32, in each of which a bearing hole 33 is formed. The second component member 34 is formed with a pair of oppositely projecting pintles 35 which engage in the bearing holes 33 of the first component member 30 for pivotal movement of one of the two component members relative to the other.

If an external force is applied to the side walls 32, they are likely to be damaged or broken adjacent the base plate 31. In locked position in which the second component member 34 lies flat or generally parallel with the base plate 31 of the first component member 30, the top ends 32' of the side walls 32 thereof project above the upper level of the second component member 34, so that when the projecting top ends contact the skin of the wearer, they feel bad and when they are pressed onto the clothes of the wearer, dimples are likely to be formed in the clothes.

SUMMARY OF THE INVENTION

Accordingly, the primary object of the invention is to provide a buckle which is completely free from the above-mentioned and other disadvantages of the conventional buckles.

The buckle constructed in accordance with the invention comprises a first and a second component member. The first component member comprises a base plate, a pair of upstanding lateral side walls integral with the base plate and a cross rod having its opposite ends integrally secured to the top ends of the side walls and extending above and in parallel with the base plate, so that the base plate, the side walls and the cross rod form a frame defining a passage through which a belt or the like is to be passed.

A bearing recess is formed in the inner surface of each of the two side walls at one side of the cross rod and a guide groove is formed in either one or both of the side walls at the opposite side of the cross rod. The guide groove extends from the peripheral edge of the side wall toward the bearing recess and has its bottom surface gradually rising toward the bearing recess, with a shoulder formed between the inner end of the guide groove and the bearing recess.

The second component member comprises a body portion and a fastening portion extending angularly from one end of the body portion, with a pair of axially aligned pintles laterally outwardly projecting from the opposite sides of the above-mentioned one end of the body portion and a bearing groove formed in the upper surface of the above-mentioned one end portion of the body portion adjacent the pintles so as to extend widthwise of the body portion.

The first and the second component members are assembled, with the pintles of the second component member being engaged in the bearing recesses of the first component member and the cross rod of the first component member being received in the bearing groove of the second component member thereby to enable pivotal movement of the second component member relative to the first component member.

DESCRIPTION OF THE PREFERRED EMBODIMENTS

Referring now to FIGS. 1 to 8, there is shown a buckle constructed in accordance with the invention, which comprises a first component member or frame A and a second component member or operative member B pivotally connected to the first component member A.

Figure 1:
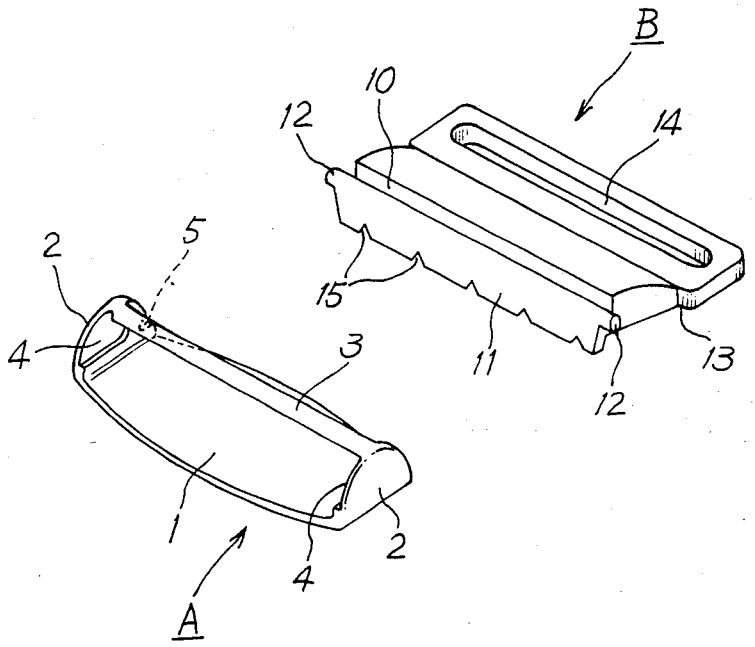
FIG. 1 is an exploded perspective view of one embodiment of the invention.
Figure 2:
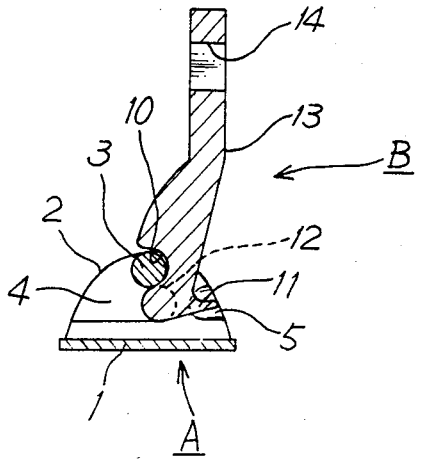
FIG. 2 is a side view, in vertical section, of the buckle of FIG. 1 with the second component member shown standing upright or in open condition.
Figure 3:
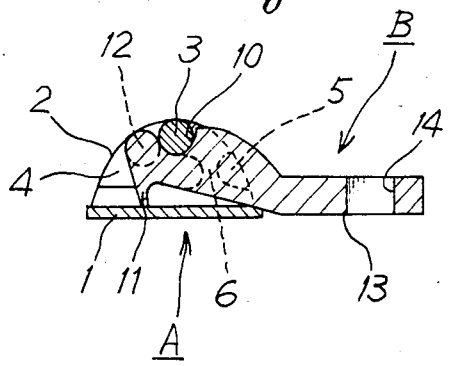
FIG. 3 is a view similar to FIG. 1 with the second component member shown lying flat or in closed condition.
Figure 4:
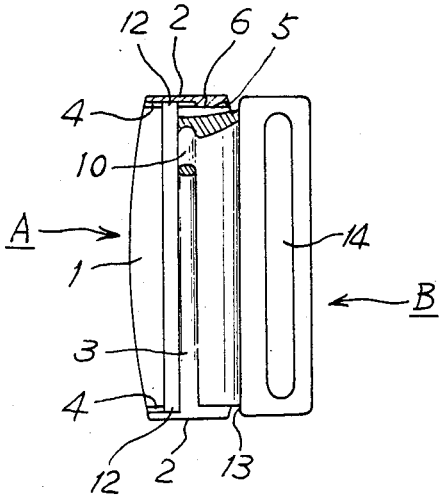
FIG. 4 is a top plan view, partially cut away, of the second component member of the buckle of FIGS. 1 to 3.
Figure 5:
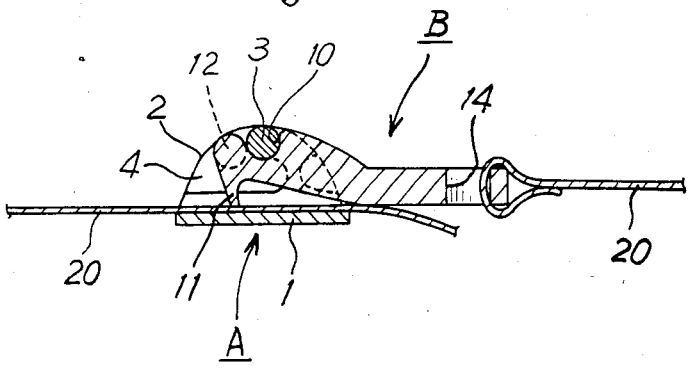
FIG. 5 is a view similar to FIG. 3 showing the buckle used with a belt.

The first component member A comprises a base plate 1, a pair of upstanding side walls 2, preferably generally semicircular, formed at the opposite sides of the base plate 1 integrally therewith, and a cross rod 3 extending between the opposite side walls 2 and having its opposite ends secured to the upper ends of the opposite side walls 2 integrally therewith, so that the base plate 1, the opposite side walls 2 and the cross rod 3 form a frame having a passage through which a belt 20 or the like is to be passed as shown in FIG. 5.

The second component member B comprises a body portion 13 and a fastening portion 11 extending from one end of the body portion 13 substantially perpendicularly thereto.

A pair of pintles 12 are formed on the above-mentioned one end of the body portion 13 so as to be axially aligned and project laterally outwardly therefrom in opposite directions. A bearing groove 10 is formed in the upper surface of the body portion 13 so as to extend across the above-mentioned one end of the body portion and in parallel with the common axis of the aligned pintles 12.

A slot 14 is formed in the opposite end of the body portion 13 of the second component member B for one end of the belt 20 to be connected thereto as shown in FIG. 5. The outer edge of the fastening portion 11 is serrated as at 15 for secure clamping of the belt 20 between the serrated edge and the upper surface of the base plate 1.

In each of the opposed inner surfaces of the side walls 2 of the first component member A there is formed at one side of the cross rod 3 a bearing recess 4 for receiving and holding one of the two opposite pintles 12 of the second component member B. In the inner surface of at least one of the two side walls 2 of the first component member A there is also formed at the side of the cross rod 3 opposite to the bearing recess 4 a groove 5 for guiding one of the pintles 12 of the second component member B into engagement in the bearing recess 4. The guide groove 5 extends from the peripheral edge of the side wall 2 inwardly thereof toward the bearing recess 4, with the bottom surface 5*a* of the guide groove 5 gradually rising toward the bearing recess 4 to form a shoulder 6 below the cross rod 3 between the inner end of the guide groove 5 and the bearing recess 4. A similar guide groove with a similar shoulder may be formed in the other side wall 2 of the first component member A.

The two component members A and B may be made of a suitable plastic material by injection molding.

The two component members A and B are connected or combined in the following manner. The second component member B is held adjacent the first component member A substantially perpendicularly thereto with the pintles 12 at the down side, and the second component member B is manipulated so that one of the pintles 12 is passed under the cross rod 3 into engagement in the bearing recess 4 of one of the two opposite side walls 2 of the first component member A. Then the other pintle 12 is engaged in and forced along the guide groove 5 over the shoulder 6 into snapping engagement in the bearing recess 4 in the other side wall 2 of the first component member A, with simultaneous engagement of the cross rod 3 of the first component member A into the bearing groove 10 in the upper surface of the second component member B.

When the two component members A and B have been combined in the above mentioned manner, the shoulders 6 on the first component member A function as a stop to prevent disengagement of the pintles 12 from the bearing recesses 4 and consequently inadvertent separation of the two component members A and B from each other.

What small degree of flexibility the material of the component members A and B have permits the pintles 12 of the second component member B to be passed over the shoulders 6 so as to be engaged in the corresponding recess 4 of the first component member A.

Figure 6:
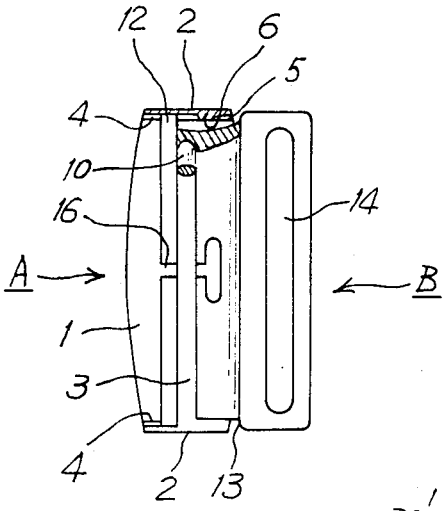
FIG. 6 is a view similar to FIG. 4 but showing a modified form of the second component member of the buckle.
Figure 9:
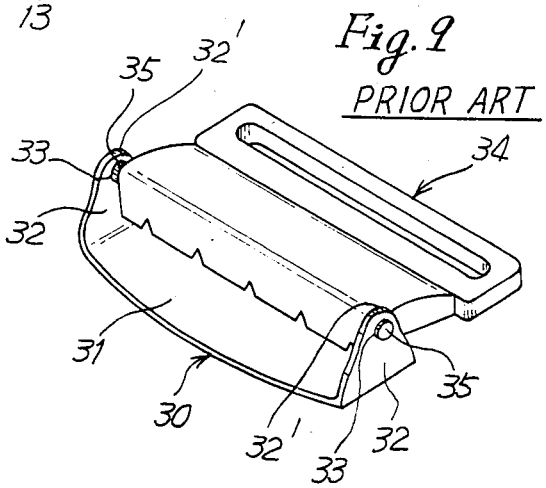
Fig. 9 PRIOR ART
FIG. 9 is a perspective view of a conventional buckle.
Figure 7:
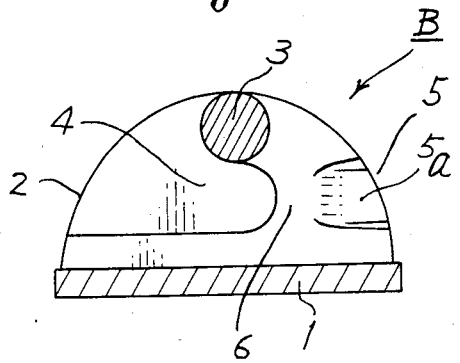
FIG. 7 is an enlarged view of the inner surface of the side wall of the first component member of the buckle.
Figure 8:
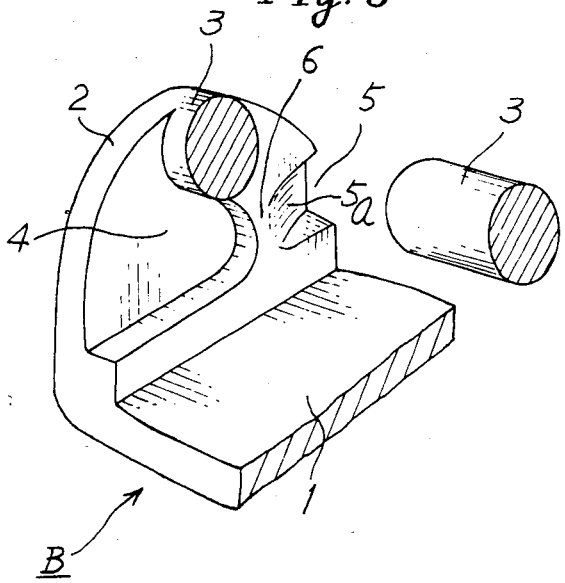
FIG. 8 is an enlarged perspective view of the side wall and adjacent portions of the first component member.

FIG. 6 shows a modified form of the second component member B, in which a T-shaped cut or recess 16 is formed in that end of the body portion 13 where the pintles 12 are provided. Due to the cut 16 the end of the body portion 13 can be resiliently compressed widthwise so that the opposite pintles 12 can be moved toward each other inwardly of the body portion 13 thereby to make it easier for the pintles 12 to be engaged in the bearing recesses 4. In this case the guide groove 5 of the second component member B need not be provided, and even if the component members A and B are made of hard plastic, it is quite easy to assemble the two component members while preventing the pintles 12 from being damaged or broken.

Thus in accordance with the invention, since the first component member A comprises a generally rectangular frame made of the base plate 1, the opposite side walls 2 and the cross rod 3, it is structurally very strong, resistive to external forces and less likely to be damaged or broken. Since the cross rod 3 has its opposite ends integrally connected to the top ends of the side walls 2 of the first component member A and the bearing groove 10 is formed in the upper surface of the second component member B, no part of the second component member B projects above the side walls 2 of the first component member A provided that the second component member B is held flat or parallel with the first component member A, so that the wearer of the buckle does not feel uncomfortable even when the buckle comes in touch with his or her skin. The buckle can be made thin in thickness, compact in size and good in appearance.

Since the bearing recesses 4 are formed in the inner surfaces of the side walls of the first component A and the pintles 12 are provided at the opposite lateral sides of one end of the second component member B, the recesses 4 hold and guide the pintles 12 as the second component member B is manipulated so as to stand upright or lie flat relative to the first component member A while preventing the second component member B in the upright position from being disconnected from the first component member A.

The buckle of the invention is made of only two component members which are easy to assemble, strong and resistive to damage and destruction, compact in size, suitable for mass production and low in cost.

What I claim is:

1. A device for fastening a belt or the like, comprising a first component member and a second component member connected to said first component member for pivotal movement relative thereto;

said first component member comprising a base plate, a pair of upstanding side walls formed at opposite sides of said base plate, and a cross rod having opposite ends connected to the integral with top ends of said side walls so that said base plate, said side walls and said cross rod form a frame defining a passage through which a belt or the like is to be passed, each of said side walls being provided with a bearing recess in an inner surface thereof said recess extending from a periphery of each of said side walls inwardly thereof;

said second component member comprising a body portion and a fastening portion extending angularly from one end of said body portion, said body portion being provided at said one end with a pair of pintles axially aligned and laterally outwardly projecting in opposite directions from the opposite lateral sides of said body portion and in an upper surface of said body portion with a bearing groove extending adjacent said one end of said body portion and in parallel with a common axis of said aligned pintles, and said body portion being further provided at an opposite end with a slot for attachment of a belt to said second component member;

said first and second component members, when assembled, having each of said pintles engaged in a corresponding one of said recesses and said cross rod engaged in said bearing groove of said body portion upper surface so that said second component member is pivotable about said cross rod between a substantially upright or open position in which said belt can freely pass through said passage of said first component member and a substantially flat or closed position in which said fastening portion of said second component member fastens said belt to said first component member.

2. The device of claim 1, wherein a belt engaging edge of said fastening portion is serrated.

3. The device of claim 1, wherein said first and second component members are made of a hard plastic material.

4. The device of claim 1, wherein said second component member is provided in said one end of said body portion with a cut which enables said pintles to be resiliently displaced toward each other thereby to enable easy connection of said second component member to said first component member.

5. The device of claim 1, wherein one of said side walls of said first component member is provided in said inner surface with a guide groove extending from the peripheral edge of said side wall inwardly thereof toward said bearing recess, with the bottom surface of said guide groove gradually rising toward said bearing recess to form a shoulder between the inner end of said guide groove and said bearing recess.

6. The device of claim 5, wherein the other of said side walls of said first component member is provided in said inner surface with a guide groove extending from the peripheral edge of said side wall inwardly thereof toward said bearing recess, with the bottom surface of said guide groove gradually rising toward said bearing recess to form a shoulder between the inner end of said guide groove and said bearing recess.

* * * * *